US007375470B2

(12) United States Patent
Baek et al.

(10) Patent No.: US 7,375,470 B2
(45) Date of Patent: May 20, 2008

(54) MAGNETRON

(75) Inventors: Chae Hyun Baek, Seoul (KR); Jong Soo Lee, Anyang-si (KR); Yong Soo Lee, Siheung-si (KR)

(73) Assignee: LG Electronics, Inc., Seoul (KR)

( * ) Notice: Subject to any disclaimer, the term of this patent is extended or adjusted under 35 U.S.C. 154(b) by 267 days.

(21) Appl. No.: 11/206,747

(22) Filed: Aug. 19, 2005

(65) Prior Publication Data

US 2006/0219548 A1 Oct. 5, 2006

(30) Foreign Application Priority Data

Mar. 29, 2005 (KR) ..... 10-2005-0026041

(51) Int. Cl.
*H01J 25/50* (2006.01)

(52) U.S. Cl. ..... 315/39.51; 315/39.57; 315/39.71

(58) Field of Classification Search ..... 315/39.51, 315/39.75, 39.57, 36.69, 39.71, 39.67
See application file for complete search history.

(56) References Cited

U.S. PATENT DOCUMENTS

| | | | | |
|---|---|---|---|---|
| 4,063,129 | A * | 12/1977 | Miura et al. | 315/39.71 |
| 4,166,235 | A * | 8/1979 | Yamashita et al. | 315/39.71 |
| 4,338,545 | A * | 7/1982 | Koinuma et al. | 315/39.71 |
| 5,635,798 | A * | 6/1997 | Ogura et al. | 315/39.71 |
| 5,861,716 | A * | 1/1999 | Ogura | 315/39.51 |
| 6,504,304 | B1 * | 1/2003 | Lee et al. | 315/39.75 |
| 6,653,788 | B2 * | 11/2003 | Ogura et al. | 315/39.51 |
| 6,670,762 | B2 * | 12/2003 | Aiga et al. | 315/39.75 |
| 7,023,137 | B2 * | 4/2006 | Ishii et al. | 315/39.51 |

* cited by examiner

*Primary Examiner*—Douglas W. Owens
*Assistant Examiner*—Chuc Tran
(74) *Attorney, Agent, or Firm*—Birch, Stewart, Kolasch & Birch, LLP

(57) ABSTRACT

Disclosed herein is a magnetron. The magnetron comprises an anode cylinder, upper and lower magnets provided to upper and lower portions of the anode cylinder, and upper and lower magnetic poles connected to the magnets, respectively. Each of the magnets has an inner diameter of 19~21 mm, a thickness of 11.5~12.5 mm, and an outer diameter of 50~54 mm.

10 Claims, 3 Drawing Sheets

MAGNETRON

This application claims the benefit of Korean Patent Application No. 2005-026041, filed on Mar. 29, 2005, which is hereby incorporated by reference as if fully set forth herein.

BACKGROUND OF THE INVENTION

1. Field of the Invention

The present invention relates to a magnetron, and more particularly, to a miniaturized magnetron.

2. Discussion of the Related Art

Generally, a magnetron is an oscillation source of microwaves for heating foods, and is utilized for microwave ovens and the like due to its simple construction and highly efficient stable behavior.

Meanwhile, since magnets mounted in the magnetron are made of a permanent magnetic material, material costs for the magnetron are increased. In particular, a conventional magnetron has a problem in that, as the magnets and upper/lower magnetic poles are excessively large, the material costs are significantly increased. Additionally, the excessively large volumes of the magnet and the poles also cause an excessive increase in size of the magnetron.

Meanwhile, since a significantly reduced magnetron possibly causes a sharp reduction in an output of the magnetron, it is difficult to miniaturize the magnetron without decreasing the output of the magnetron.

Thus, the present invention is directed to a magnetron, which has a reduced size without being lowered in output performance.

SUMMARY OF THE INVENTION

Accordingly, the present invention is directed to a magnetron that substantially obviates one or more problems due to limitations and disadvantages of the related art.

An object of the present invention is to provide a magnetron, which has a reduced size without being reduced in output performance.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a magnetron comprises an anode cylinder, upper and lower magnets provided to upper and lower portions of the anode cylinder, and upper and lower magnetic poles connected to the magnets, respectively, wherein each of the magnets has an inner diameter of 19~21 mm, a thickness of 11.5~12.5 mm, and an outer diameter of 50~54 mm.

Preferably, a distance between the upper and lower magnetic poles is 10.5~11.5 mm. Preferably, each of the magnetic poles has an outer diameter of 34~35 mm. Preferably, a distance between an upper end of the upper magnetic pole and a lower end of the lower magnetic pole is about 23.5 mm. Preferably, the magnets are made of a ferrite material.

In another aspect of the present invention, a magnetron comprises an anode cylinder, upper and lower magnets provided to upper and lower portions of the anode cylinder, and upper and lower magnetic poles connected to the magnets, respectively, wherein each of the magnets has an inner diameter of 19~21 mm and an outer diameter of 51~54 mm, the upper magnet has a thickness of 11.5~12.5 mm, and the lower magnet has a thickness of 9.5~10.5 mm.

Preferably, a distance between the upper and lower magnetic poles is 10.5~11.5 mm. Preferably, each of the magnetic poles has an outer diameter of 34~35 mm. Preferably, a distance between an upper end of the upper magnetic pole and a lower end of the lower magnetic pole is about 23.5 mm. Preferably, the magnets are made of a ferrite material.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
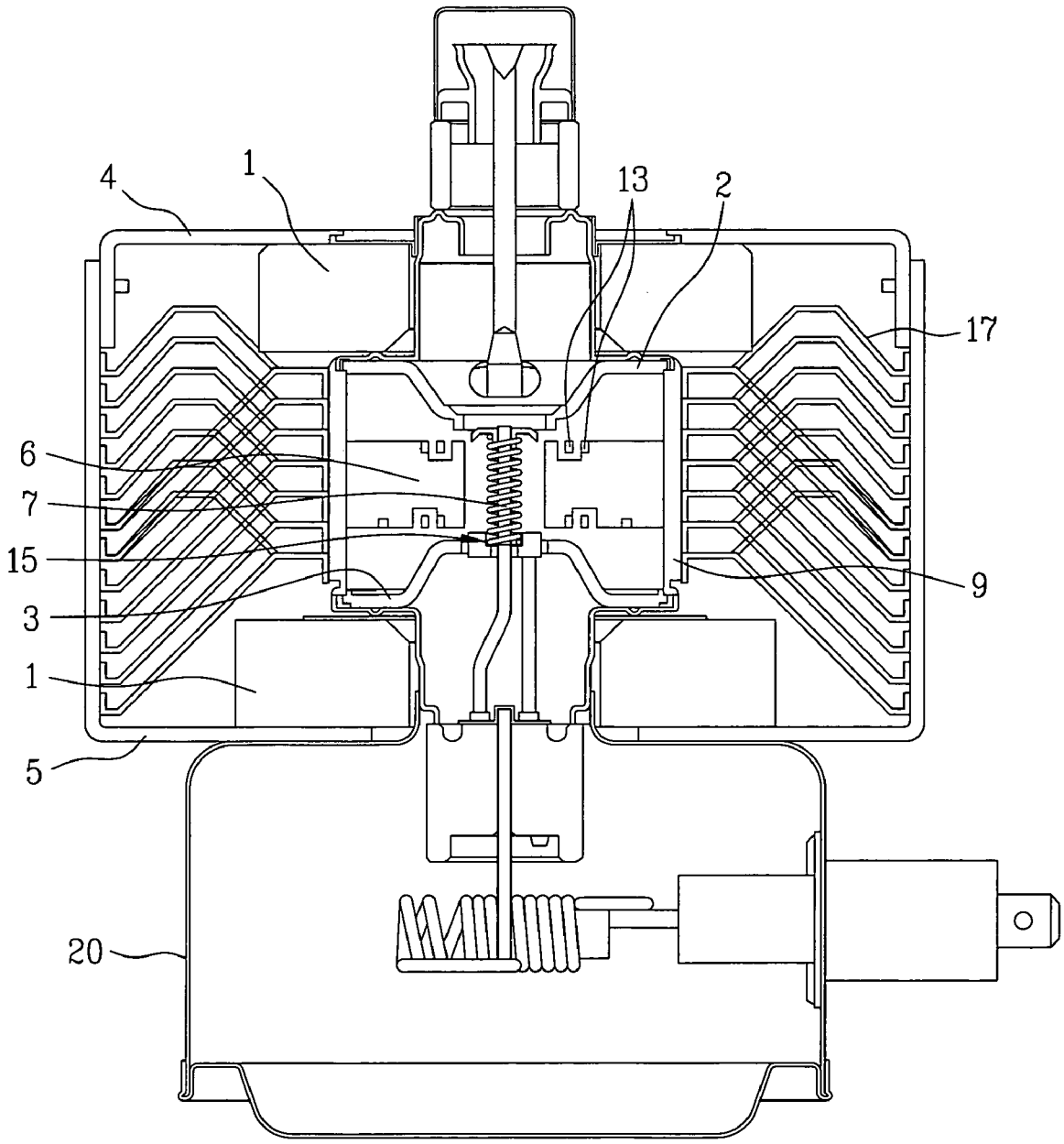
FIG. 1 is a cross-sectional view illustrating a magnetron according to the present invention.

FIG. 1 is a cross-sectional view illustrating a magnetron according to the present invention.

As shown in FIG. 1, the magnetron comprises an anode cylinder 9, anode vanes 6, inner/outer straps 13, a cathode 15, a plurality of cooling fins 17, yokes 4 and 5, magnets 1, and a filter box 20.

The anode cylinder 9 has a cylindrical shape, and the anode vanes 6 are radially equipped into an inner wall of the anode cylinder 9 to constitute a resonant cavity. The inner/outer straps 13 are alternately arranged on upper and lower surfaces of the anode vanes 6 to electrically connect the vanes, and the cathode 15 includes a spiral filament 7 centered in the magnetron and acting as a negative electrode.

The plural cooling fins 17 are arranged on an outer periphery of the anode cylinder 9 for the purpose of heat dissipation. The cooling fins 17 are protected and supported by the upper and lower plate-shaped yokes 4 and 5. Moreover, the cooling fins 17 are arranged to allow outer air to be guided thereto. The magnets 1 for generating a magnetostatic field are equipped to upper and lower portions of the anode cylinder 9, and connected to upper and lower magnetic poles 2 and 3, respectively.

The filter box 20 is provided to the lower portion of the magnetron.

Operation of the magnetron will be described as follows.

Initially, when the filament 7 is heated, electrons are emitted. Here, an electrostatic field is induced between the cathode 15 and the resonant cavity, and a magnetostatic field is induced in upper and lower directions of the resonant cavity between the upper and lower magnetic poles 2 and 3. As a result, the electrons are subjected to cycloid movement in a reaction space between the cathode and the resonant cavity by virtue of forces from the electrostatic field and the magnetostatic field.

At this time, the electrons under the cycloid movement gradually move into the resonant cavity while interacting with the high frequency electric field previously applied between the vanes, during which most of the energy of the electrons is converted into high frequency energy. After being accumulated in the resonant space, the high frequency energy is supplied to the upper portion of the magnetron, and radiated to the outside via an antenna connected to the vanes 6. The radiated high frequency energy is used to heat the foods.

Meanwhile, with the energy of the electrons being radiated to the outside, the electrons reach the resonant space, from which the rest energy of the electrons are finally converted into thermal energy.

As such, heat generated from the vanes 6 is effectively dissipated by the plural cooling fins 17 arranged around the outer periphery of the anode cylinder, thereby preventing the magnetron from being degraded by the heat.

Meanwhile, the high frequency energy output generated from the magnetron is related to intensity of the magnetic field generated between the upper magnetic pole 2 and the lower magnetic pole 3. The intensity of the magnetic field is varied by the construction of the magnet.

If the characteristics of the magnetron are maintained while reducing the sizes of the magnets 1 and the upper/lower magnetic poles 2 and 3, the manufacturing costs can be remarkably reduced. Thus, considering that investigation for reducing the size thereof while maintaining the output performance has not been progressed, it is urgently needed to conduct investigation for reducing the size of the magnetron in view of effective resource management and the manufacturing cost.

The construction of the magnetron for size reduction will be described in detail as follows.

Figure 2:
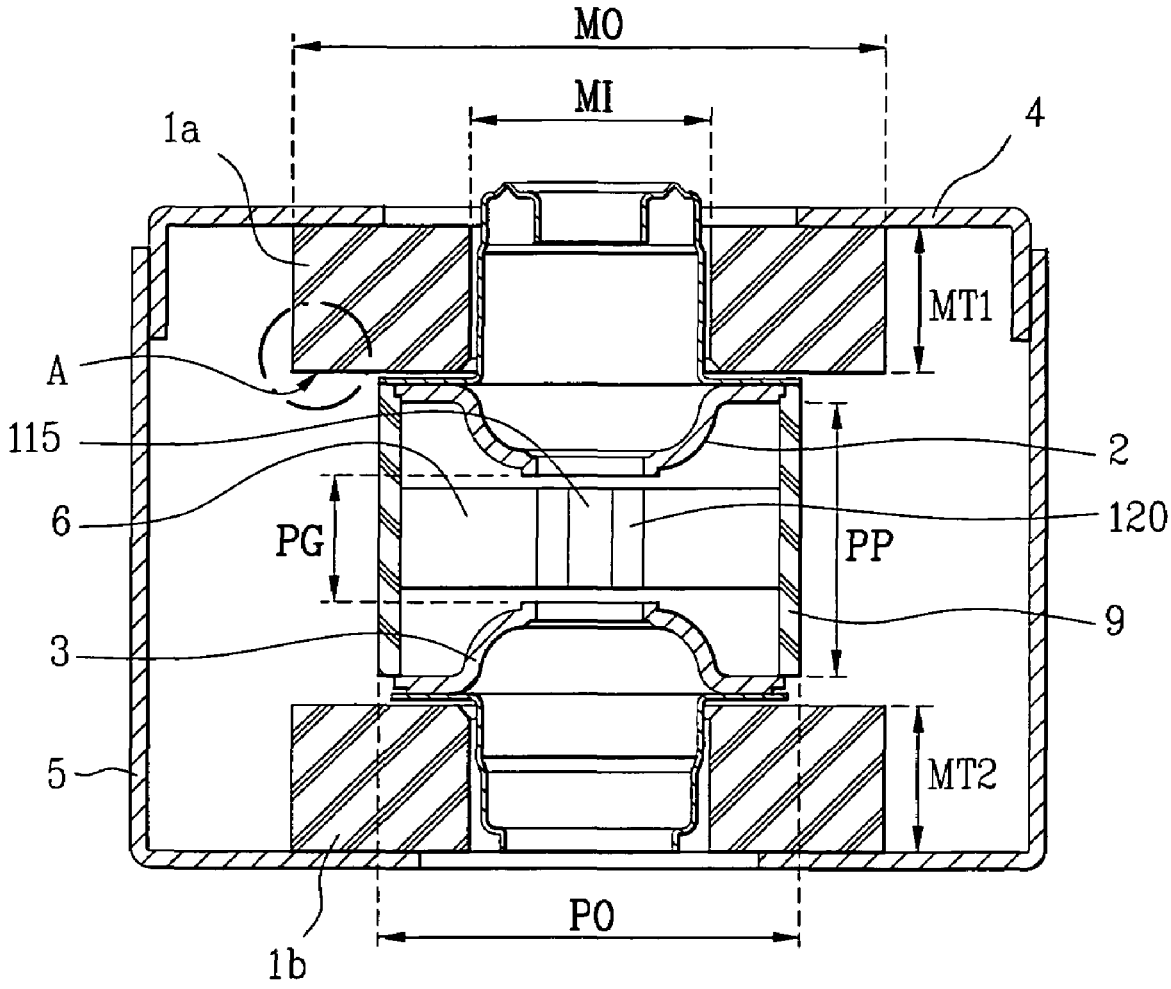
FIG. 2 is a cross-sectional view illustrating the construction of the magnetron according to the present invention.

FIG. 2 is a cross-sectional view illustrating the construction of the magnetron according to the present invention. Since a detailed description of the general construction of the magnetron has been given with reference to FIG. 1, the general construction thereof will not be described in any further detail.

As shown in FIG. 2, the magnetron of the invention comprises an anode cylinder 9, anode vanes 6, a cathode 115, yokes 4 and 5, upper/lower magnetic poles 2 and 3, and upper/lower magnets 1*a* and 1*b*.

The anode cylinder 9 has a cylindrical shape, and the anode vanes 6 are radially equipped into an inner wall of the anode cylinder 9 to constitute a resonant cavity. It is desirable that inner/outer straps (not shown) be alternately arranged on upper and lower surfaces of the anode vanes 6 to electrically connect the vanes.

The cathode 15 includes a spiral filament centered in the magnetron and acting as a negative electrode. A reaction space 120 for generating high frequency energy is defined between the anode vanes 6. The outer periphery of the anode cylinder is equipped with a plurality of cooling fins for heat dissipation, which is preferably protected and supported by the upper and lower plate-shaped yokes 4 and 5.

The upper and lower magnets 1*a* and 1*b* for generating a magnetostatic field are equipped to upper and lower portions of the anode cylinder 9, and connected to upper and lower magnetic poles 2 and 3, respectively. Preferably, the magnets 1*a* and 1*b* are permanent magnets made of a ferrite-based material.

Operation of the magnetron will be described as follows.

Initially, when the filament 7 is heated, electrons are emitted. Here, an electrostatic field is induced between the cathode 115 and the resonant cavity, and a magnetostatic field is induced in upper and lower directions of the resonant cavity between the upper and lower magnetic poles 2 and 3. As a result, the electrons are subjected to cycloid movement in a reaction space between the cathode and the resonant cavity by virtue of forces from the electrostatic field and the magnetostatic field.

At this time, the electrons under the cycloid movement gradually move into the resonant cavity while interacting with high frequency electric field previously applied between the vanes 6, during which most of the energy of the electrons is converted into high frequency energy in the reaction space 120. After being accumulated in the resonant space, the high frequency energy is supplied to the upper portion of the magnetron, and radiated to the outside via an antenna connected to the vanes 6.

The high frequency energy from the magnetron can be used for heating foods in a cooking apparatus, such as microwave oven, or can be used for other heating apparatuses.

The high frequency energy output is related to intensity of the magnetic field generated between the upper and lower magnetic poles 2 and 3. Meanwhile, the intensity of the magnetic field is varied by the constructions of the magnets 1*a* and 1*b* and the magnetic poles 2 and 3.

That is, as a distance PG between the upper and lower magnetic poles 2 and 3 is decreased, the intensity of the magnetic field is increased. Additionally, as an outer diameter PO of the upper and lower magnetic poles 2 and 3 is decreased, magnetic field leakage is increased, so that the intensity of the magnetic field is decreased. This is attributed to the fact that the magnetic field is leaked from a portion A where the magnetic poles 2 and 3 do not overlap the magnets 1*a* and 1*b*.

Thus, in order to reduce the size of the magnetron while generating high frequency energy output of a desired intensity, the magnetron must be manufactured under consideration of a critical value of the energy output according to the construction of the magnets 1*a* and 1*b* and the magnetic poles 2 and 3.

A proper distance between the upper and lower magnetic poles 2 and 3, and the size of the magnets 1*a* and 1*b*, and the critical significance thereof will be described hereinafter with reference to results of tests.

The tests were conducted in two stages, which will be referred to as a first test and a second test for classification, respectively.

First, the first test will be described.

Figure 3:
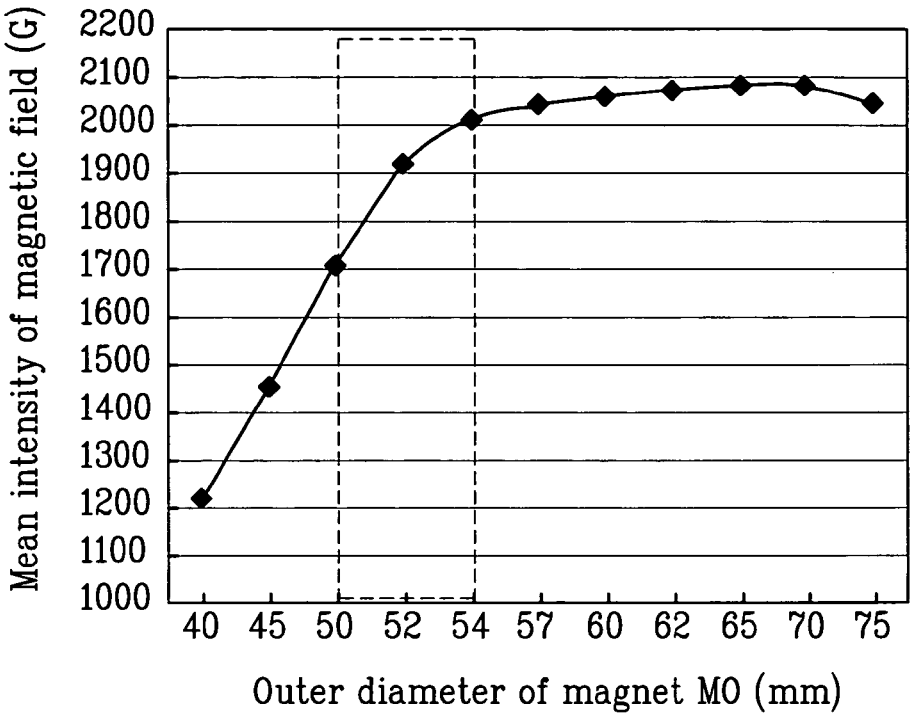
FIGS. 3 and 4 are graphs depicting variation in mean intensity of magnetic field versus an outer diameter of a magnet in the magnetron according to the present invention.

FIG. 3 is a graph showing the results of the first test for manufacturing the size-reduced magnetron of the invention.

Specifically, the first test was conducted under the condition in which a distance PG between the upper and lower magnetic poles 2 and 3 is 10.5~11.5 mm, and an outer diameter PO of the magnetic poles is 34~35 mm. At this time, it is desirable that a distance between an upper end of the upper magnetic pole and a lower end of the lower magnetic pole is 23.5 mm. The size of the magnetic poles and the distance therebetween are applied to the magnetron having a reduced size compared with the conventional magnetron.

Here, FIG. 3 is a graph depicting variation in mean intensity of the magnetic field versus an outer diameter MO of the magnets in the magnetron, in which each of the magnets 1*a* and 1*b* has an inner diameter MI of 19~21 mm, a thickness MT1 or MT2 of 11.5~12.5 mm. In FIG. 3, the high frequency energy output is proportional to the intensity of the magnetic field.

As shown in FIG. 3, until the outer diameter MO of the magnets 1*a* and 1*b* reaches 52 mm, the intensity of the magnetic field is rapidly increased with increase of the outer diameter MO. In other words, when the magnets 1*a* and 1*b* have an outer diameter of 52 mm or less, the intensity of the magnetic field is rapidly decreased with decrease of the outer diameter MO.

Here, the magnetron requires an output of about 500~1,000 W available in practice, and this requirement can be satisfied under the condition in which the intensity of the magnetic field is 1,700 gauss or more. As shown in FIG. 3, it can be seen that, when the magnets 1*a* and 1*b* have an outer diameter of 52 mm or more, the intensity of the magnetic field can be 1,700 gauss or more.

Meanwhile, when the outer diameter MO of the magnets exceeds 54 mm, the intensity of the magnetic field remains in an approximately identical level even if the outer diameter MO is increased. However, when the outer diameter MO of the magnets exceeds 70 mm, the intensity of the magnetic field is decreased on the contrary with increase of the outer diameter MO. Accordingly, it can be understood that the outer diameter MO of 54 mm is a critical value, over which the intensity of the magnetic field remains in the approximately identical level even if the outer diameter MO is increased.

This is caused by an increase of magnetic field leakage resulting in loss of magnetic force occurring when the outer diameter MO is increased to a predetermined level or more. More specifically, referring to FIG. 2, primary leakage of magnetic force occurs at the portion A where the magnetic poles 2 and 3 do not overlap the magnets 1*a* and 1*b*.

Moreover, a predetermined space is defined between the side surfaces of the magnets 1*a* and 1*b* and the upper and lower yokes 4 and 5, and when the space is narrowed with increase of the outer diameter MO of the magnets 1*a* and 1*b*, an eddy current phenomenon is generated in the space, causing secondary leakage of magnetic force. When increasing the distance between the side surfaces of the magnets 1*a* and 1*b* and the yokes 4 and 5 in order to prevent the eddy current phenomenon, an overall volume of the magnetron is increased.

Thus, when the magnets 1*a* and 1*b* have the outer diameter of 54 mm or more, the magnetron is excessively increased in size, causing the material costs to be raised.

As described above, in order to maintain the high frequency energy generated from the magnetron in a predetermined level or more with the upper and lower magnets having a thickness MT1 or MT2 of 11.5~12.5, the outer diameter MO of the magnets must be in the range of 50~70 mm. Moreover, in order to reduce the size of the magnetron, the outer diameter MO of the magnets is preferably in the range of 50~54 mm. With such a construction as described above, the magnetron can be reduced in size while generating desired high frequency energy.

Next, the second test will be described.

Figure 4:
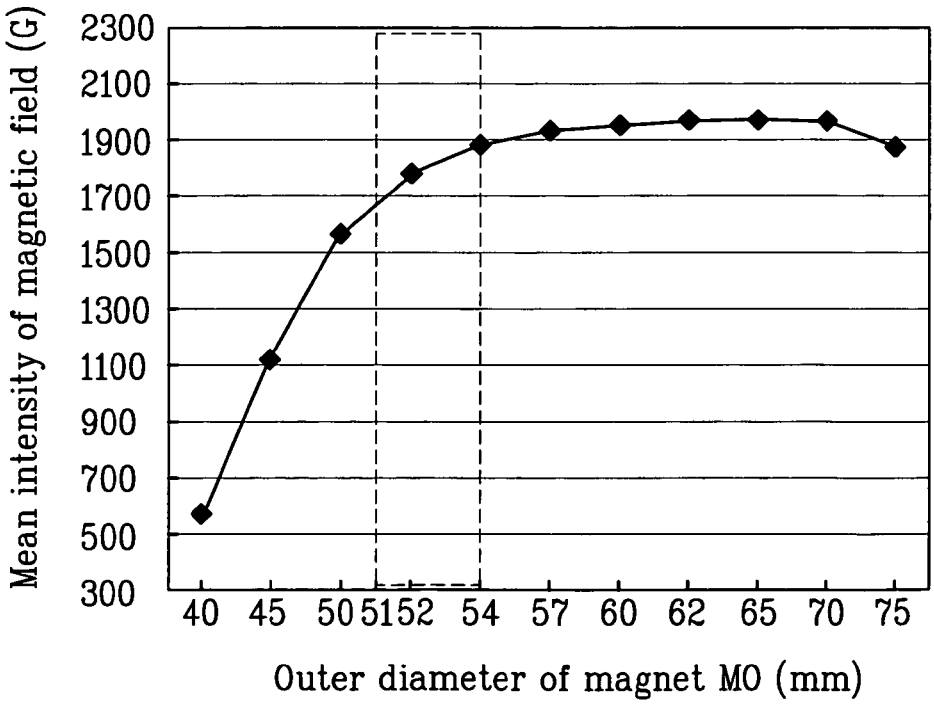

FIG. 4 is a graph showing results of the second test for manufacturing the size-reduced magnetron of the invention.

Here, as with the first test, the second test was conducted under the condition in which the distance PG between the upper and lower magnetic poles 2 and 3 is 10.5~11.5 mm, and the outer diameter PO of the magnetic poles is 34~35 mm. At this time, it is desirable that a distance between the upper end of the upper magnetic pole and the lower end of the lower magnetic pole is 23.5 mm. The magnetron has an inner diameter MI of 19~21 mm.

Meanwhile, unlike the first test, the upper and lower magnets 1*a* and 1*b* have different thicknesses, respectively, in the second test. That is, FIG. 4 is a graph depicting variation in mean intensity of the magnetic field versus an outer diameter MO of the magnets 1*a* and 1*b*, in which the magnet 1*a* has a thickness MT1 of 11.5~12.5 mm, and the magnet 1*b* has a thickness MT2 of 9.5~10.5 mm. In FIG. 4, the high frequency energy output is proportional to the intensity of the magnetic field.

As shown in FIG. 4, until the outer diameter MO of the magnets 1*a* and 1*b* reaches 52 mm, the intensity of the magnetic field is rapidly increased with increase of the outer diameter MO. In other words, when the magnets 1*a* and 1*b* have an outer diameter less than 52 mm, the intensity of the magnetic field is rapidly decreased with decrease of the outer diameter MO.

Here, the magnetron requires an output of about 500~1,000 W available in practice, and this requirement can be satisfied under the condition in which the intensity of the magnetic field is 1,700 gauss or more. As shown in FIG. 4, it can be seen that, when the magnets 1*a* and 1*b* have an outer diameter of at least 51 mm or more, the intensity of the magnetic field can be 1,700 gauss or more.

Meanwhile, when the outer diameter MO of the magnets exceeds 54 mm, the intensity of the magnetic field remains in an approximately identical level even if the outer diameter MO is increased. However, when the outer diameter MO of the magnets exceeds 70 mm, the intensity of the magnetic field is decreased on the contrary with increase of the outer diameter MO. Accordingly, it can be understood that the outer diameter MO of 54 mm is a critical value, over which the intensity of the magnetic field remains in the approximately identical level even if the outer diameter MO is increased.

This is caused by an increase of magnetic field leakage resulting in loss of magnetic force occurring when the outer diameter MO exceeds 54 mm. Since a detailed description of this phenomenon has been already given above, it will be omitted.

Thus, when the magnets 1*a* and 1*b* have the outer diameter of 54 mm or more, the magnetron is unnecessarily increased in size, causing the material costs to be raised.

As described above, in order to maintain the high frequency energy generated from the magnetron in a predetermined level or more with the upper magnet having a thickness MT1 of 11.5~12.5 mm and the lower magnet having a thickness MT2 of 9.5~10.5 mm, the outer diameter MO of the magnets 1*a* and 1*b* must be in the range of 51~70 mm. Moreover, in order to reduce the size of the magnetron, the outer diameter MO of the magnets is preferably in the range of 51~54 mm. With such a construction as described above, the magnetron can be reduced in size while generating desired high frequency energy.

Accordingly, since the magnetron according to the invention is reduced 20% in size without deteriorating the performance thereof, it is possible to reduce a price of the products incorporating the magnetron while contributing to an increase in competitiveness of the products. Moreover, a space occupied by the magnetron is reduced, thereby allowing an inner space of an electric room of the microwave oven to be effectively utilized.

As apparent from the above description, the present invention has effects as follows.

Firstly, the magnetron can be reduced in size while generating high frequency energy output. Thus, the magnetron of the invention can reduce the material costs while supplying optimum performance.

Secondly, since the magnetron is reduced in size while having a desired performance, an inner space for a mounting space thereof, such as an electric compartment, can be effectively utilized.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A magnetron comprising an anode cylinder, upper and lower magnets provided to upper and lower portions of the anode cylinder, and upper and lower magnetic poles connected to the magnets, respectively, wherein each of the magnets has an inner diameter of 19~21 mm, a thickness of 11.5~12.5 mm, and an outer diameter of 50~54 mm, wherein an outer diameter of each of the magnetic poles is smaller than the outer diameter of the magnets by 15-20 mm.

2. The magnetron as set forth in claim 1, wherein a distance between the upper and lower magnetic poles is 10.5~11.5 mm.

3. The magnetron as set forth in claim 1, wherein each of the magnetic poles has an outer diameter of 34~35 mm.

4. The magnetron as set forth in claim 1, wherein a distance between an upper end of the upper magnetic pole and a lower end of the lower magnetic pole is about 23.5 mm.

5. The magnetron as set forth in claim 1, wherein the magnets are made of a ferrite material.

6. A magnetron comprising an anode cylinder, upper and lower magnets provided to upper and lower portions of the anode cylinder, and upper and lower magnetic poles connected to the magnets, respectively, wherein each of the magnets has an inner diameter of 19~21 mm and an outer diameter of 51~54 mm, the upper magnet has a thickness of 11.5~12.5 mm, and the lower magnet has a thickness of 9.5~10.5 mm, wherein an outer daimeter of each of the magnetic poles is smaller than the outer diameter of the magnets by 16-20 mm.

7. The magnetron as set forth in claim 6, wherein a distance between the upper and lower magnetic poles is 10.5~11.5 mm.

8. The magnetron as set forth in claim 6, wherein each of the magnetic poles has an outer diameter of 34~35 mm.

9. The magnetron as set forth in claim 6, wherein a distance between an upper end of the upper magnetic pole and a lower end of the lower magnetic pole is about 23.5 mm.

10. The magnetron as set forth in claim 6, wherein the magnets are made of a ferrite material.

* * * * *